US006588810B1

(12) United States Patent
Monneret

(10) Patent No.: US 6,588,810 B1
(45) Date of Patent: Jul. 8, 2003

(54) CLOSING DEVICE WITH SELECTIVE LOCKING

(75) Inventor: Jean-Jacques Monneret, Villeurbanne (FR)

(73) Assignee: Norinco, Saint Crepin Ibouvillers (FR)

( * ) Notice: Subject to any disclaimer, the term of this patent is extended or adjusted under 35 U.S.C. 154(b) by 0 days.

(21) Appl. No.: 09/743,256

(22) PCT Filed: Jul. 9, 1999

(86) PCT No.: PCT/FR99/01688

§ 371 (c)(1),
(2), (4) Date: Mar. 12, 2001

(87) PCT Pub. No.: WO00/03097

PCT Pub. Date: Jan. 20, 2000

(30) Foreign Application Priority Data

Jul. 10, 1998 (FR) ..... 98 08934

(51) Int. Cl.[7] ..... E05C 3/06

(52) U.S. Cl. ..... 292/200; 292/101; 292/DIG. 11; 292/DIG. 27; 292/DIG. 30; 292/DIG. 63; 292/96; 292/100; 404/25; 52/19; 52/20

(58) Field of Search ..... 70/159–164, 167–169, 70/171–173, 166, 170; 404/25, 26; 292/100, 96, 101, 126, 200, 226, DIG. 11, DIG. 27, DIG. 63, DIG. 30, DIG. 12, 336.3; 16/443; 52/19, 20

(56) References Cited

U.S. PATENT DOCUMENTS 3,921,494 A * 11/1975 Coe ..... 292/192
3,977,124 A * 8/1976 Oger ..... 49/463
3,994,520 A * 11/1976 Oger ..... 292/256.73
4,144,729 A * 3/1979 Nielsen, Jr. ..... 292/284
4,175,781 A * 11/1979 Dumortier ..... 292/218
4,481,797 A * 11/1984 Milo ..... 220/214
4,523,407 A * 6/1985 Miller ..... 404/25
4,627,249 A * 12/1986 Dumortier ..... 292/204
5,079,935 A * 1/1992 Zaucha ..... 292/251
5,324,135 A * 6/1994 Smith ..... 210/164
5,366,317 A * 11/1994 Solimar ..... 220/325
5,666,831 A * 9/1997 Doros ..... 292/291
2002/0025223 A1 * 2/2002 Suatac ..... 404/26

FOREIGN PATENT DOCUMENTS

| | | |
|---|---|---|
| EP | 383 374 | 8/1990 |
| GB | 902286 | 8/1962 |

OTHER PUBLICATIONS

Snap–on Catalog #300, 1975, p. 265.*

* cited by examiner

*Primary Examiner*—Robert J. Sandy
*Assistant Examiner*—Dinesh N Melwani
(74) *Attorney, Agent, or Firm*—Leydig, Voit & Mayer, Ltd.

(57) ABSTRACT

A closing device with selective locking for closing a frame includes a roughly flat lid selectively applied to the frame, a lock connected with the lid, and a key which has a socket and an arm, one end of the arm carrying the socket. The lid has an opening for access to the lock by the key, the lock has a latch which cooperates with a catch of the frame, and the key selectively assumes, with respect to an opening, a locking position which the key can leave freely and in which the latch is trapped by the catch, and an unlocking position in which the key is trapped in the opening and in which the latch is disengaged from the catch. The arm and the socket of the key are roughly perpendicular to one another, and the arm is roughly perpendicular to the lid when the key is in the unlocking position.

14 Claims, 4 Drawing Sheets

6
3
II
8
7
1a
17
X'
1
19
X
17
10
4
9a
7a
9
5
11
16
20
21
18
14
22
13
24
25
23
26
15b
15a
15

VIII
IX
VI

CLOSING DEVICE WITH SELECTIVE LOCKING

FIELD OF THE INVENTION

The present invention relates in a general manner to a device enabling one to close a frame and which has a lid which can be locked on the frame a key and a lock connected with the lid.

More precisely, the invention relates to a closing device with selective locking for closing a frame, which has a roughly flat lid selectively applied to the frame, a lock connected with the lid, and a key which has a socket and an arm one end of which carries the socket, the lid having an opening for access to the lock for the key, the lock having a latch which cooperates with a catch of the frame, and the key selectively assuming, with respect to the opening, a locking position, which the key can assume and leave freely, and in which the latch is trapped by the catch, and an unlocking position for which the key is trapped in the opening and for which the latch is disengaged from the catch.

BACKGROUND

A device of this type is known in the prior art and is described in the patent document EP 0 383 374.

However, while this known device relates specifically to a vertical advertising frame, closed,by a lightweight lid, the present invention refers to different applications and particularly to an application in which the lid is a cast iron cover closing, for example, a refuse hole provided in a roadway.

Two problems arise in the type of applications envisaged by the invention, namely, on one hand, difficulties in handling of the lid, which result directly from the high weight and possibly from the horizontal arrangement of the lid, and on the other hand, the need to prevent acts of vandalism and particularly to provide against unauthorized opening of the lid.

SUMMARY OF THE INVENTION

The aim of the invention is precisely to propose a device which can solve these problems.

For this purpose, the device of the invention, otherwise according to the generic definition of it given in the preamble above, is essentially characterized by the fact that the arm and the socket of the key are roughly perpendicular to one another, and by the fact that the arm is roughly perpendicular to the lid in the unlocking position of the key.

Thanks to this arrangement, the lid can be raised by the key while being held by the whole lateral surface of the socket and not simply by two stubs as is the case according to the specification of the earlier patent document mentioned, this solution being unsuitable for cast iron pieces because of their weight and their manufacturing tolerances.

Moreover, inasmuch as the socket is roughly parallel to the plane of the lid, the locking and unlocking mechanism is not directly visible and remains inaccessible to standard tools.

Under these conditions, it is, for example, possible to make it such that the opening gives access to a cavity of the lid into which a hole opens, and such that the opening has the shape of an "L" of which one limb, perpendicular to the hole, allows the key to pass from one of its positions, locking and unlocking, to the other when the socket is inserted in the hole, and prohibits movement of the arm parallel to the hole when the arm is roughly perpendicular to the lid while the socket is inserted in the hole.

The cavity advantageously has a first wall in the form of an inclined plane and which ensures the guiding of the socket in the cavity.

In order to make handling of the lid by means of the key even more easy, this key preferably has a handle connected with the arm, roughly parallel to the socket and arranged opposite it.

The aforementioned hole can be formed in a second wall, orthogonal to the first wall, with it possible for a shaft bearing the latch then to be arranged in the hole.

The aforementioned socket can have an internal axial rib capable of cooperating with an axial groove arranged on the shaft bearing the latch.

Furthermore, the socket of the key preferably has, on its opening part, two external opposite stubs capable of cooperating with guiding ribs at the bottom of the aforementioned cavity and of passing through the aforementioned hole whose edge has notches whose form corresponds to said stubs.

The shaft bearing the latch is, for example, mounted so as to turn on a lug parallel to the aforementioned wall containing the hole and has a flat part in order to connect in rotation the shaft and the latch which has the form of angle iron.

Preferably, the latch is elastically held by a limb of the angle iron on the aforementioned lug and between this lug and the aforementioned wall with the hole by means of a spring and washers.

The other limb of the angle iron forming the latch is, for example, capable of cooperating with a notch forming a catch arranged in a longitudinal member inside the frame.

The limb of the angle iron held on the lug advantageously has a hole with a flat part cooperating with the aforementioned flat part on the shaft for rotating the latch.

BRIEF DESCRIPTION OF THE INVENTION

Other characteristics an advantages of the invention will appear more clearly in the following detailed description in reference to the appended drawings, given only as an example, and in which.

DETAILED DESCRIPTION

Figure 1:
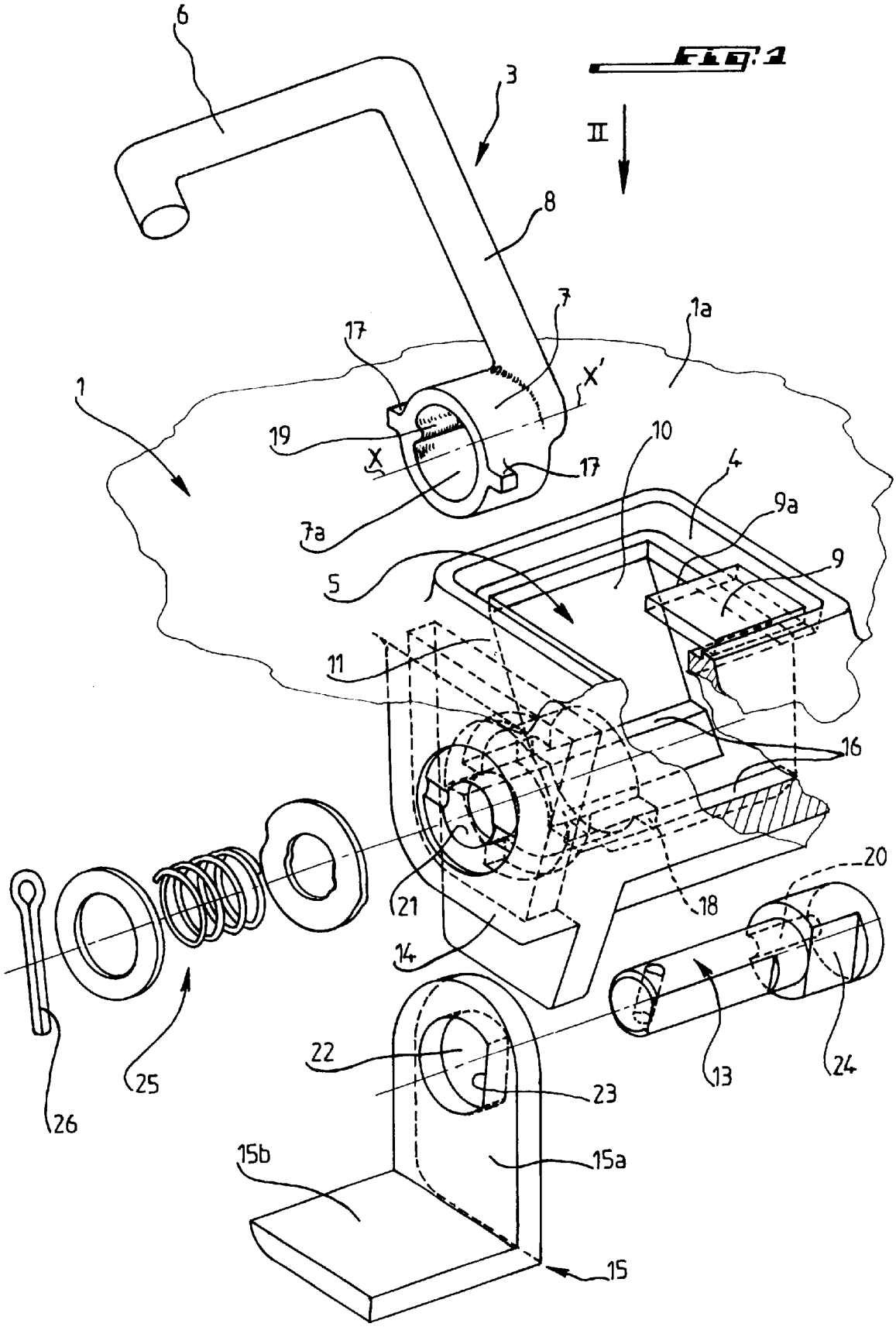
FIG. 1 is an exploded view in perspective of a portion of a cover for closing a hole provided with a device for locking and unlocking with a special and unique key according to this invention.
Figure 4:
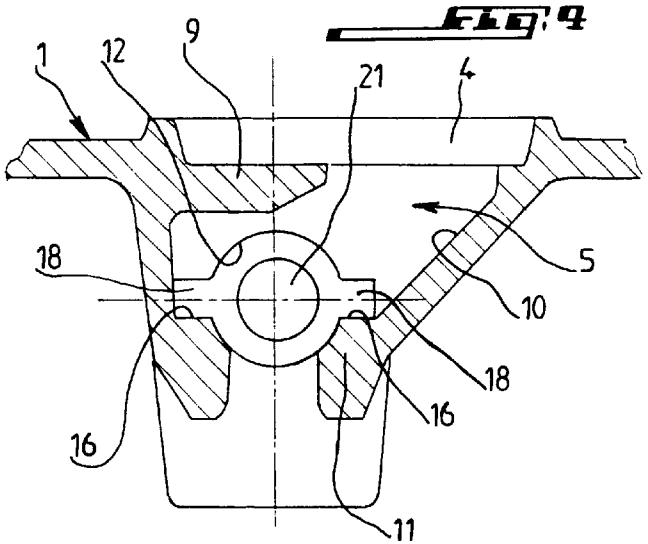
FIG. 4 is a view in section according to line IV—IV of FIG. 2.
Figure 2:
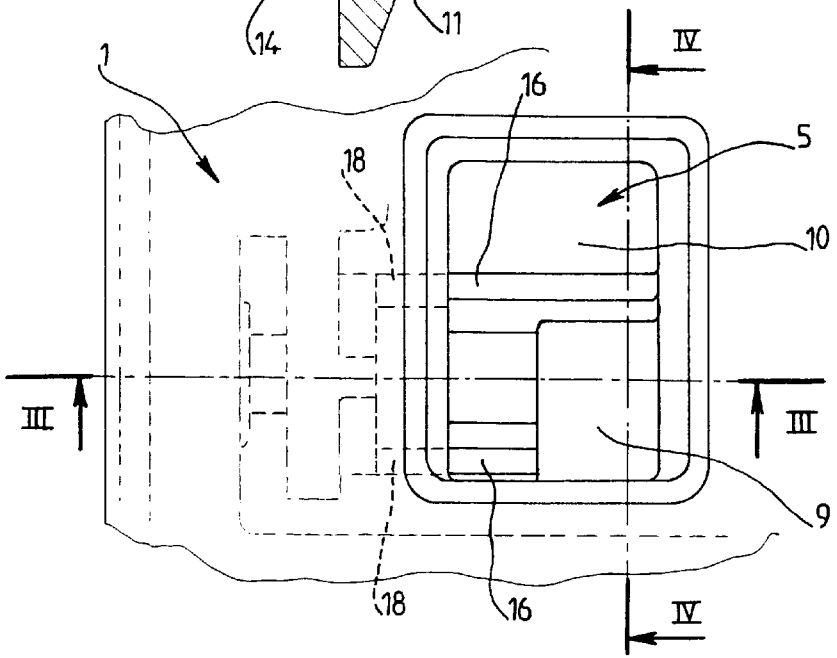
FIG. 2 is a top view according to arrow II of FIG. 1 showing only the opening of the cover with its associated cavity which is intended for receiving the key (not represented) for actuation of the lock (which is also not represented)

A locking device according to this invention is quite particularly intended for equipping cover, lid or similar 1 capable of closing a frame, framework or similar marked as 2 in FIGS. 5 to 8 and delimiting the opening of a refuse hole, for example.

This locking device can be actuated by a key which is marked in a general manner as 3 in FIGS. 1 and 5 to 12.

According to the invention, upper wall 1*a* of cover or lid 1 has access opening 4 for key 3; this opening opens, on one hand, towards the exterior of cover 1, and on the other hand, into cavity 5 in the vicinity of the bottom of which the locking mechanism, as described in detail further on, is mounted.

As appears clearly in FIG. 1, key 3 has part 6 forming a handle and socket 7 connected to handle 6 by arm 8.

According to the invention, handle 6 and socket 7 respectively extend from the two ends of arm 8 according to two orthogonal directions that have the same direction. In order words, axis X—X' of socket 7 is roughly parallel to handle 6 which extends in the same direction as that of said socket.

Access opening 4 for key 3, quite particularly for socket 7 of this key, is partially closed by plate 9 or similar which gives opening 4 an L shape. In effect, it is seen in FIGS. 1, 2, 5 and 7 in particular that according to the execution example represented, opening 4 has the shape of a rectangle of which one of the comers is closed by plate 9 which has a roughly square shape, so that the remaining opening part of opening 4 in the upper wall of cover 1 roughly has the shape of an L in which key 3 can of course be introduced and maneuvered as will be described later.

Cavity 5 associated with cover 1 and situated below plate 9 has wall 10 in the form of an inclined plane which ensures the guiding of socket 7 of key 3 in said cavity. This cavity 5 also has wall 11, clearly visible in FIGS. 3, 6 and 8 and which is orthogonal to wall 10 in the form of an inclined plane.

Wall 11 has hole 12 through which socket 7 of key 3 can pass, so that said socket can then engage with shaft 13 mounted so as to pivot on lug 14 connected with cover 1, and which [shaft] bears a latch marked in a general manner as 15.

Provided in the bottom of cavity 5 are opposite guiding ribs 16. Once socket 7 of the key is introduced in cavity 5, ribs 16 constitute a means of stopping and guiding in translation of socket 7 of key 3 by the intermediary of two external opposite stubs 17 provided on the exterior of opening part 7*a* of said socket 7. Hole 12 arranged in wall 11 of cavity 5 has, in its edge, notches 18 whose form corresponds to stubs 17 of socket 7 so as to allow said socket to pass and allow it to engage with shaft 13 bearing latch 15.

In addition to stubs 17, socket 7 has an internal and axial rib which can be seen at 19 in FIG. 1. This rib can cooperate with axial groove 20 with a corresponding shape arranged on shaft 13 which carries and drives latch 15, when key 3 is operated.

This shaft 13 is mounted so as to turn in hole 21 provided in lug 14 and situated in the axis of hole 12 arranged in wall 11 of cavity 5 and so as to give access to socket 7 of key 3, as will be explained in detail later.

Figure 3:
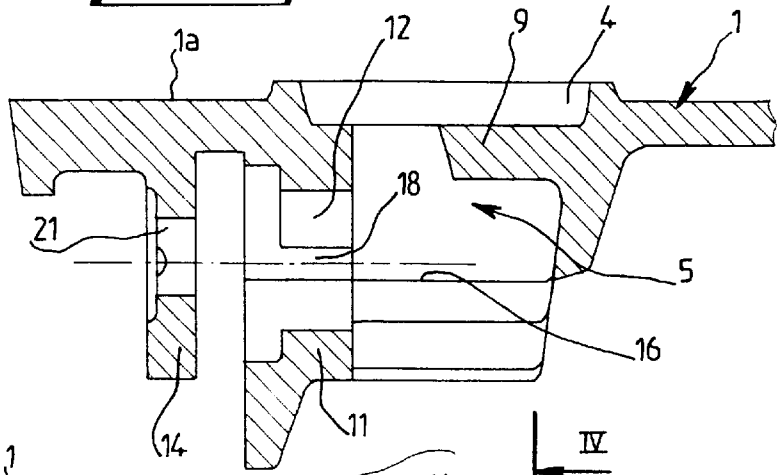
FIG. 3 is a view in section according to line III—III of FIG. 2.
Figures 5, 6, 7, 8:
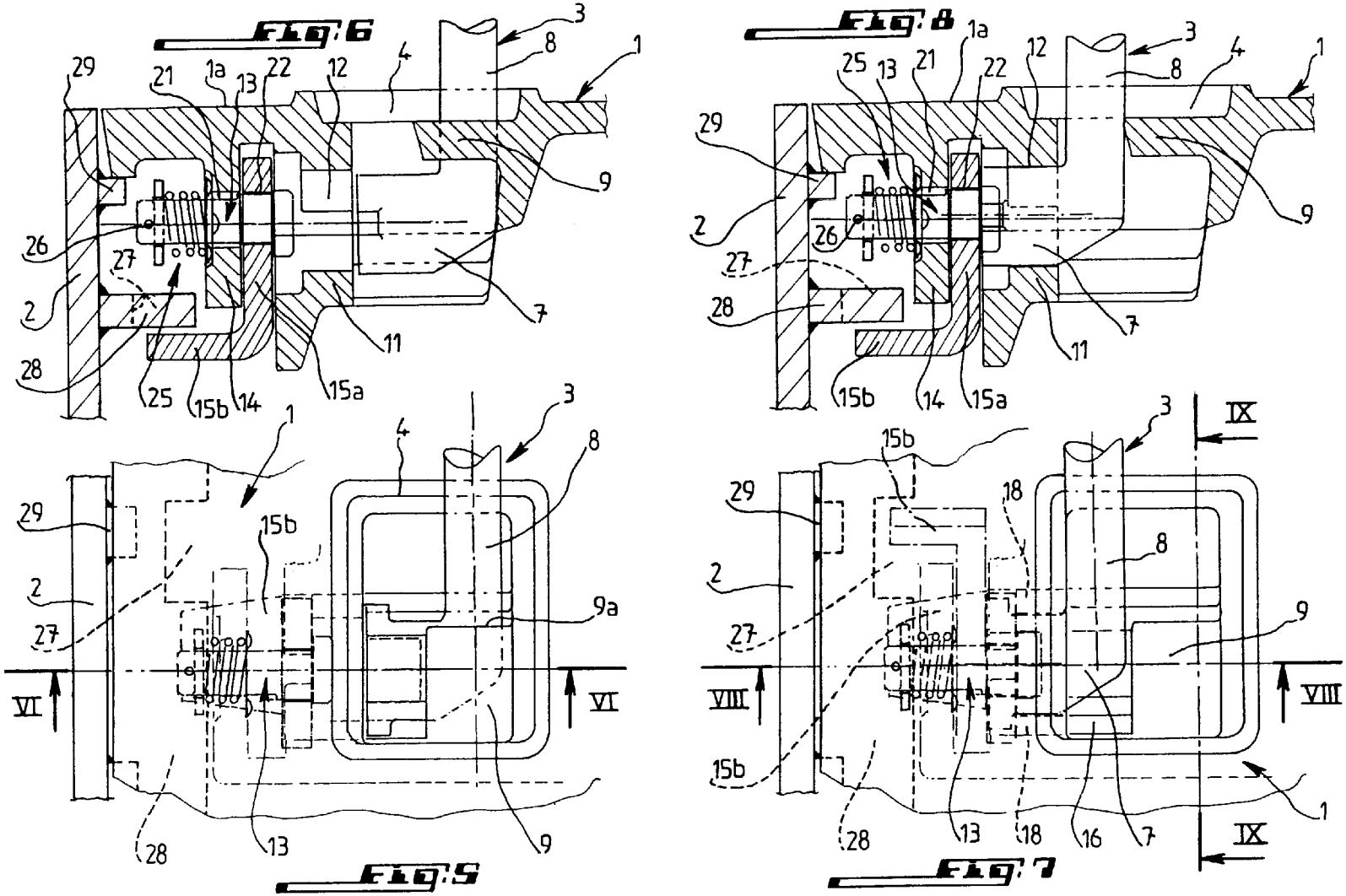
FIG. 5 is a top view similar to FIG. 2 but showing the lock in locked position and the key simply introduced into the bottom of the cavity associated with the opening of the cover.
FIG. 6 is a view in section according to line VI—VI of FIG. 5.
FIG. 7 is a view similar to FIG. 5 but showing the socket of the key engaged with the shaft for rotating the latch.
FIG. 8 is a view in section according to line VIII—VIII of FIG. 7.

As clearly seen in FIGS. 3, 6 and 8 in particular, lug 14 is parallel to wall 11, and between the lug and the wall, latch 15 can turn, latch which has the form of an angle iron, according to the execution example represented. One 15*a* of the limbs of the angle iron has hole 22 with flat part 23, just as shaft 13 for driving latch 15 has flat part 24. Thus, thanks to the two cooperating flat parts 23, 24 of latch 15 and of shaft 13, the latter can rotate the latch when rib 19 of socket 7 belonging to key 3 is engaged with groove 20 of shaft 13.

Shown as 25 in FIGS. 1, 6 and 8 in particular, is a stack of washers with a spring which elastically holds, by the intermediary of pin 26, limb 15*a* of angle iron 15 on lug 14 between this lug and wall 11 of cavity 5 in cover 1.

The other limb 15*b* of angle iron 15 constitutes the active part of the latch, in the sense that this is the part which will cooperate in practice with a notch or similar marked 27 in FIGS. 5 and 7 and arranged in longitudinal member or similar 28 projecting to the interior of frame 2.

Shown as 29 in FIGS. 5 to 8 are seating stops for cover 1 on frame 2, these stops being above longitudinal member 28 which has the notch forming catch 27 inside frame 2.

In order to facilitate comprehension of the invention, we will now describe how the device with a key which has just been described functions, in reference more particularly to FIGS. 9 to 12.

Figures 9, 10, 11, 12:
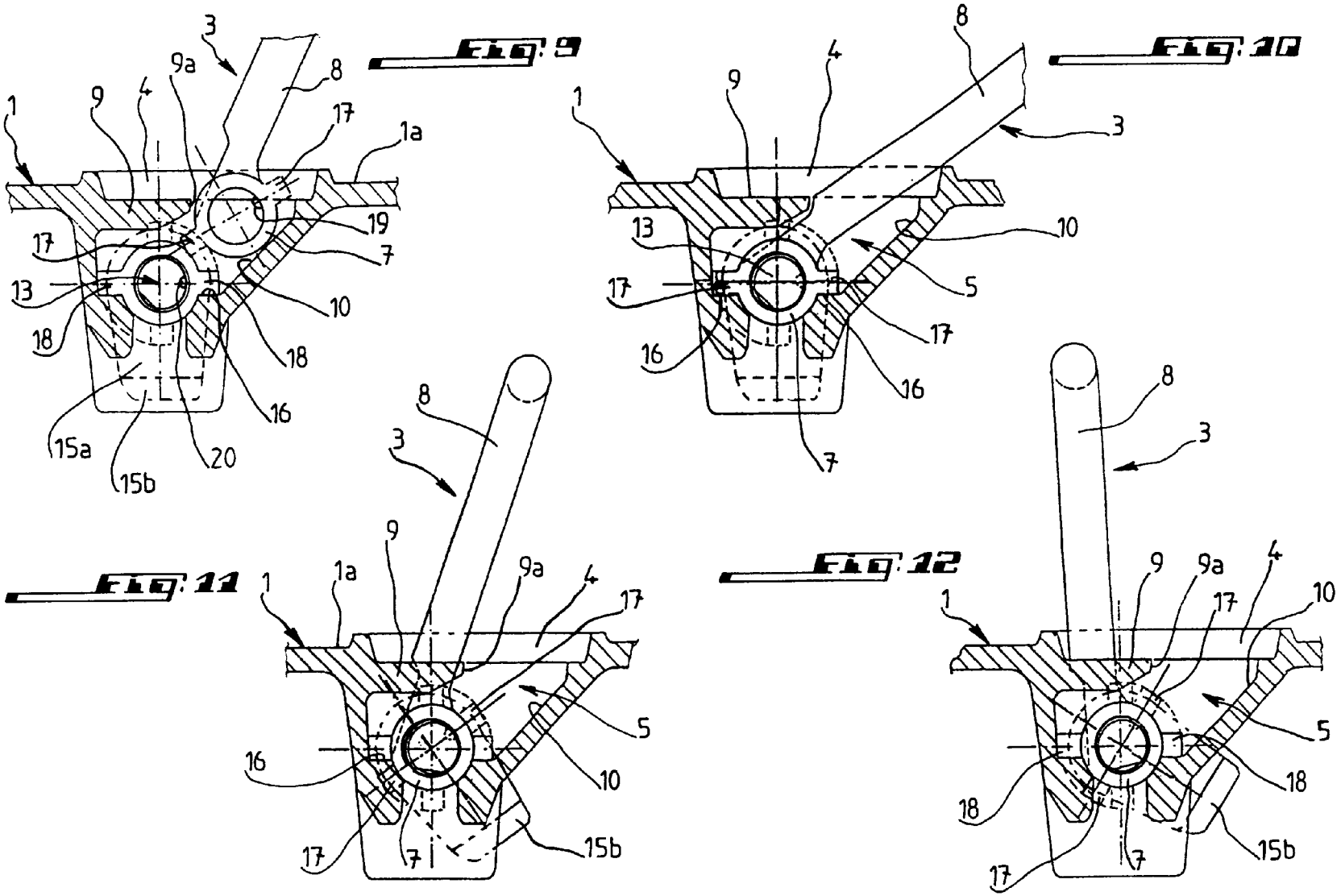
FIGS. 9 to 12 illustrate in section roughly according to line IX—IX of FIG. 7, the successive positions of the key and of the lock in order to go from the locked position to the unlocked position of the cover on the frame.

As seen in FIGS. 1 and 9, socket 7 of key 3 is introduced through opening 4 into cavity 5, and this introduction can only occur for a single direction of the key, namely that which can be seen in FIG. 1. More precisely, socket 7 slides over wall 10 in the form of an inclined plane of cavity 5 until opposite stubs 17 of socket 7 stop on ribs 16 at the bottom of said cavity, as seen in FIG. 10 and also in FIGS. 5 and 6. It should be noted that in this position, key 3 is blocked by its arm 8 between the edge of opening 4 and the opposite edge 9*a* of plate 9.

Thus immobilized, key 3 can only be actuated by translation by sliding of stubs 17 of socket 7 on ribs 16 of cavity 5, until the socket, passing through hole 12 of wall 11, engages with shaft 13 of latch 15 by its rib 19 which penetrates in groove 20 of shaft 13.

It is appropriate to specify here that FIG. 9 shows latch 15 in locked position in notch 27 of frame 2.

When socket 7 is therefore engaged with shaft 13 for driving latch 15, as seen clearly in FIGS. 7 and 8, arm 8 of key 3 escapes from the position of immobilization described in the preceding, in one of the limbs of the L formed by opening 4, and comes at right angles with the other limb of the L, so that key 3 can be rotated, as seen in FIGS. 11 and 12, in order thus to rotate shaft 13 and therefore latch 15 which can be disengaged by its part 15*b* from notch 27 of frame 2.

Cover 1 is therefore "open", and key 3 remains coupled to shaft 13 and is maintained trapped by its arm 8 in opening 4 (see FIG. 12) which makes it possible to raise cover 1 out of frame 2 with key 3.

Cover 1 can of course be put back in closed position on frame 2 with key 3 which remains trapped in cavity 5 in unlocked position of latch 5.

In order to lock cover 1 on frame 2 again, it is sufficient to tilt it [the key] and then translate it in cavity 5 according to a direction opposite that described in the preceding, so as to be able to take socket 7 out of said cavity.

It is therefore necessary to give key 3 in cavity 5 a translational movement and then a rotational movement or the opposite in order to respectively unlock or lock the cover on its frame, going from one of the limbs of the L to the other formed by opening 4 with its associated plate 9.

Therefore, produced according to the invention is a latch-catch mechanism which is invisible from the outside and remains inaccessible unless the key of special shape according to the invention is used. One sees in effect that it will be impossible, without using this key, and even if using a commercial bent socket key, to seek the shaft for driving the latch, that is to say, to introduce the socket in the bottom of the cavity so that it is exactly aligned with the shaft for driving the latch, in order to allow the socket to engage with said shaft.

It should be noted in passing that in FIG. 7, which represents the socket of the key of the invention engaged with the shaft, while latch 15*b* is in locked position, we have nevertheless shown, for better comprehension, said latch in the form of dotted lines in order to illustrate how, in unlocked position, it escapes from notch 27 of interior longitudinal member 28 belonging to frame 2.

What is claimed is:

1. A closing device with selective locking for closing a frame comprising a substantially flat lid or rigid manhole cover selectively applied to the frame, a lock connected with the lid, and a key which has a socket and an arm, one end of the arm carrying the socket, the lid having an upper wall and an opening for access to the lock for the key, the lock having a latch which cooperates with a catch on the frame, and the key selectively assuming, with respect to the opening, a locking position in which the key can leave freely and in which the latch is trapped by the catch, and an unlocking position in which the key is trapped in the opening and in which the latch is disengaged from the catch, wherein the arm has an axis and the socket has an axis substantially perpendicular to the axis of the arm so that the socket can engage into a hole for access to said latch, provided in the lid under its upper wall, the hole having an axis parallel to the upper wall such that the socket is inserted into the hole along the axis of the hole, and the arm is substantially perpendicular to the lid when the key is in the unlocking position and the key has a handle connected to the other end of the arm and substantially perpendicular to the arm to allow an operator to lift the lid when in its unlocked position and to lower the lid to its closed position.

2. The closing device according to claim 1, wherein the opening gives access to a cavity of the lid into which said hole for access to said latch opens, and the opening has the shape of an "L" of which one limb, perpendicular to the hole axis, allows the key to rotate about the axis of the socket from one of the locking and unlocking positions to the other position when the socket is inserted in the hole, and prohibits translation of the arm parallel to the hole when the arm is substantially perpendicular to the lid and the socket is inserted in the hole.

3. The closing device according to claim 2, wherein the cavity has a first wall inclined to guide the socket in the cavity.

4. The closing device according to claim 1, wherein said handle is opposite the socket.

5. The closing device according to claim 3, wherein the hole is formed in a second wall, orthogonal to the first wall, and a shaft bearing the latch is arranged in the hole.

6. The device according to claim 5, wherein the socket has an internal axial rib cooperating with an axial groove on the shaft bearing the latch.

7. The device according to claim 2, wherein the socket of the key has, on an opening part, two external opposite stubs cooperating with guiding ribs at the bottom of the cavity and passing through the hole, having an edge with notches corresponding to the stubs.

8. The device according to claim 6, wherein the shaft bearing the latch turns on a lug parallel to the second wall and having a flat part connecting to the rotation shaft and the latch as an angle iron.

9. The device according to claim 8, wherein the latch is elastically held by a first limb of the angle iron between the lug and the second wall in the hole by a spring and washers.

10. The device according to claim 9, wherein a second limb of the angle iron cooperates with the catch in a longitudinal member.

11. The device according to claim 9, wherein a second limb of the angle iron has a hole with a flat part cooperating with the flat part on a shaft for rotating the latch.

12. A closing device with selective locking for closing a frame comprising:

a substantially flat and rigid lid selectively applied to a frame;

a lock connected with the lid; and a key which has a socket and an arm, a first end of the arm carrying the socket, the lid having an opening for access to the lock for the key, the lock having a latch which cooperates with a catch on the frame, and the key selectively having, with respect to the opening, a locking position which the key can leave freely and in which the latch is trapped by the catch, and an unlocking position in which the key is trapped in the opening and in which the latch is disengaged from the catch wherein the arm has an axis and the socket has an axis substantially perpendicular to the axis of the arm so that the socket can engage a hole in the lid for access to the latch, the hole being located in the lid under an upper wall, and having an axis parallel to the upper wall, such that the socket is inserted into the hole along the axis of the hole, the arm is substantially perpendicular to the lid when the key is in the unlocking position, the key has a handle connected to a second end of the arm and substantially perpendicular to the arm for lifting the lid in the unlocked position and lowering the lid to a closed position, the opening providing access to a cavity of the lid into which the hole for access to the latch opens, and the opening has an "L" shape of which one limb, perpendicular to the axis of the hole, allows the key to rotate about the axis of the socket from one of the locking and unlocking positions to the other of the unlocking and locking positions when the socket is inserted in the hole, and prohibits translation of the arm parallel to the hole when the arm is substantially perpendicular to the lid and the socket is inserted in the hole.

13. A closing device with selective locking for closing a frame comprising:

a substantially flat and rigid lid selectively applied to a frame;

a lock connected with the lid; and a key which has a socket and an arm, a first end of the arm carrying the socket, the lid having an opening for access to the lock for the key, the lock having a latch which cooperates with a catch on the frame, and the key selectively having, with respect to the opening, a locking position which the key can leave freely and in which the latch is trapped by the catch, and an unlocking position in which the key is trapped in the opening and in which the latch is disengaged from the catch wherein the arm has an axis and the socket has an axis substantially perpendicular to the axis of the arm so that the socket can engage a hole in the lid for access to the latch, the hole being located in the lid under an upper wall, and having an axis parallel to the upper wall, the arm is substantially perpendicular to the lid when the key is in the unlocking position, the key has a handle connected to a second end of the arm and substantially perpendicular to the arm for lifting the lid in the unlocked position and lowering the lid to a closed position, the opening providing access to a cavity of the lid into which the hole for access to the latch opens, the opening has an "L" shape of which one limb, perpendicular to the axis of the hole, allows the key to rotate about the axis of the socket from one of the locking and unlocking positions to the other of the unlocking and locking positions when the socket is inserted in the hole, and prohibits translation of the arm parallel to the hole when the arm is substantially perpendicular to the lid and the socket is inserted in the hole, the cavity has a first wall secured to the lid and inclined to guide the socket in the cavity, the socket of the key has, on an opening part, two external opposing stubs cooperating with guiding ribs at a bottom of the cavity and passing through the hole, having an edge with notches corresponding to the stubs, so that when the key is introduced into the cavity, the socket can firstly slide in a guided manner over the inclined first wall until the opposing stubs stop on the ribs and then can translate by sliding of the stubs on the ribs until the socket, passing through the hole, engages the latch.

14. A closing device with selective locking for closing a frame comprising:

a substantially flat and rigid lid selectively applied to a frame;

a lock connected with the lid; and a key which has a socket and an arm, a first end of the arm carrying the socket, the lid having an opening for access to the lock for the key, the lock having a latch which cooperates with a catch on the frame, and the key selectively having, with respect to the opening, a locking position which the key can leave freely and in which the latch is trapped by the catch, and an unlocking position in which the key is trapped in the opening and in which the latch is disengaged from the catch wherein the arm has an axis and the socket has an axis substantially perpendicular to the axis of the arm so that the socket can engage a hole in the lid for access to the latch, the hole being located in the lid under an upper wall , and having an axis parallel to the upper wall, the arm is substantially perpendicular to the lid when the key is in the unlocking position, the key has a handle connected to a second end of the arm and substantially perpendicular to the arm for lifting the lid in the unlocked position and lowering the lid to a closed position, the opening providing access to a cavity of the lid into which the hole for access to the latch opens, the opening has an "L" shape of which one limb, perpendicular to the axis of the hole, allows the key to rotate about the axis of the socket from one of the locking and unlocking positions to the other of the unlocking and locking positions when the socket is inserted in the hole, and prohibits translation of the arm parallel to the hole when the arm is substantially perpendicular to the lid and the socket is inserted in the hole, the cavity has a first wall secured to the lid and inclined to guide the socket in the cavity, the hole is located in a second wall of the lid, orthogonal to the first wall, a shaft bearing the latch is arranged in the hole, and the shaft bearing the latch turns on a lug parallel to the second wall, having a flat part connecting to the shaft and the latch as an angle iron.

* * * * *